US006884969B1

(12) United States Patent
Brach et al.

(10) Patent No.: US 6,884,969 B1
(45) Date of Patent: Apr. 26, 2005

(54) DIE OVEN AND METHOD OF OPERATING A DIE OVEN

(75) Inventors: Jeffrey D. Brach, Sparta, MI (US); John C. Bugai, Belmont, MI (US)

(73) Assignee: Granco Clark, Inc., Belding, MI (US)

( * ) Notice: Subject to any disclaimer, the term of this patent is extended or adjusted under 35 U.S.C. 154(b) by 0 days.

(21) Appl. No.: 10/729,291

(22) Filed: Dec. 5, 2003

(51) Int. Cl.[7] ..... F27D 5/00; F27D 11/02; F27D 19/00

(52) U.S. Cl. ..... 219/392; 219/411; 219/413

(58) Field of Search ..... 219/392, 411, 219/413; 374/179; 373/136; 432/18

(56) References Cited

U.S. PATENT DOCUMENTS 1,815,061 A * 7/1931 Harsch et al. ..... 373/136
4,570,053 A * 2/1986 Ades et al. ..... 219/413

OTHER PUBLICATIONS

Rapid Infrared Preheating of Extrusion Die, http://www.oit-.doe.gov/imf/pdfs/alcoapres.pdf (last visited Nov. 17, 2003).
Visual Management Made Easy with Castool Single Cell Ovens, http://www.castool.com/a_solutions/DieMgmt02.pdf (last visited Nov. 17, 2003).
Single Cell Die Ovens, http://www.castool.com/a_solutions/DieOvens02.pdf (last visited Nov. 17, 2003).

Fielding, Roger A., et al., A Review of Systems for Heating Extrusion Dies, Light Metal Age, 48–59 (Aug. 1998).

* cited by examiner

*Primary Examiner*—J. Pelham
(74) *Attorney, Agent, or Firm*—Warner Norcross & Judd LLP

(57) ABSTRACT

An infrared die oven has a die cradle for holding a die. A thermocouple is positioned within the die cradle to maintain it in direct contact with the die. A controller connected to the thermocouple continually reads the temperature of the die. When the die reaches a threshold temperature, the intensity of an infrared heating elements in the oven is reduced. When the die reaches the desired temperature, the controller continuously adjusts the intensity of the heater to maintain the die at the desired temperature.

28 Claims, 4 Drawing Sheets

DIE OVEN AND METHOD OF OPERATING A DIE OVEN

BACKGROUND OF THE INVENTION

The present invention relates to die ovens, and more particularly to single cell die ovens.

Metallic extrusion is a popular method to produce a variety of products. In a typical extrusion, a hot metal billet is placed in a hydraulic press and squeezed at high pressure through a preheated die. The metal emerges from the die in the desired cross section.

The preheating of the die is critical. If the die is too hot, the life of the die may be shortened. For example, if it is too cold, the quality of the extruded metal will not be satisfactory or the die may even break. A die for aluminum extrusion should be preheated to a temperature in the range of 800 to 900 degrees Fahrenheit before the die is used.

Die ovens are often used for preheating the die. Single cell die ovens preheat one die. By locating one or more single cell die ovens near the press, the efficiency of the operation of the press is increased. Infrared heating elements or electric heating elements are used in the single cell die ovens to decrease the amount of time required to preheat the die.

Infrared die ovens heat the die much faster than a conventional die oven. Because the die is heating much faster, precise control of the die temperature is difficult. Additionally, when the infrared heating elements are initially energized, the amount of heat generated will ramp up. When the infrared heating elements are turned off, the heaters will ramp down.

If the size and temperature of the die is known when the die is placed into the oven, experimentally derived or calculated die heating curves can be used to determine the amount of time required to preheat the die. After the amount of time for heating the die has lapsed, temperature sensors measure the temperature of the air in the oven. A controller then maintains the air temperature inside the oven at a desired level.

The problem with such a solution is obvious. The oven operator has to insure that each die placed in the oven is of correct size and temperature and that the correct heating curve is inputted to the control system for that die. This increases the complexity of operating the die oven and increases the possibility of improperly heating the die. For example, if a die is removed from a press for service to the press, the die must be allowed to cool to room temperature before being preheated in the die oven. If not, the die could be heated to a temperature which would structurally or materially damage the die.

An improved single cell oven which is flexible allowing for the use of dies of different size and temperature is thus highly desirable.

SUMMARY OF THE INVENTION

The aforementioned problems are overcome in the present invention.

A die oven for heating a die has at least one infrared heating element, a die cradle and a temperature gauge. The temperature gauge is in physical contact with the die when the die is placed in the die oven. A controller is connected to the temperature gauge and the infrared heating elements. The controller adjusts the heating level of the infrared heating elements in response to a die temperature signal obtained from the temperature gauge. The temperature gauge could be a thermocouple comprised of an alumel rod and a chromel rod. Any dissimilar metal pair suitable for use in thermocouples could be used.

The die oven of claim could have a die cradle. The die cradle has a first mantle and a second mantle arranged in a v-shape. The angle of the V-shape would change dependent upon the diameter of the die. The cradle is of such a design that the die must contact the thermocouple when the die is resting on the cradle. One rod extends through and across the first mantle while the second rod extends through and across the second mantle.

The die oven is operated by first reading the thermocouple to obtain a die temperature and adjusting the heat level of the infrared heating elements in response to the die temperature. The infrared heating elements are energized only if the die is properly positioned within the die oven.

After the infrared heating elements are energized, the die temperature is continuously read and compared to a threshold temperature. When the die temperature meets or exceeds the threshold temperature, the heat level of the infrared heating elements is reduced.

When the die temperature reaches a desired temperature, the intensity of the infrared heating elements is continually adjusted to maintain the die temperature near the desired temperature.

There are many advantages to such a die oven and its method of operation. The temperature of the die can be precisely controlled, without regard to the size and shape of the die. The die oven can compensate for the temperature of the die. Thus, the die does not have to be at room temperature before heating it in the die oven. It is also possible to reduce the time required to ready a die for use in a press by holding the die at a high temperature in a conventional die oven, and then raising the temperature of the die to the desired temperature in the infrared die oven. If a die had to be removed from the press for some reason, the die would need only to be placed in the die oven to be reheated. It would not need to be allowed to cool to room temperature.

Thus, the efficiency of the press is improved and the production costs could be decreased.

These and other objects, advantages and features of the invention will be more readily understood and appreciated by reference to the detailed description of the drawings.

DETAILED DESCRIPTION OF THE DRAWINGS

Figure 1:
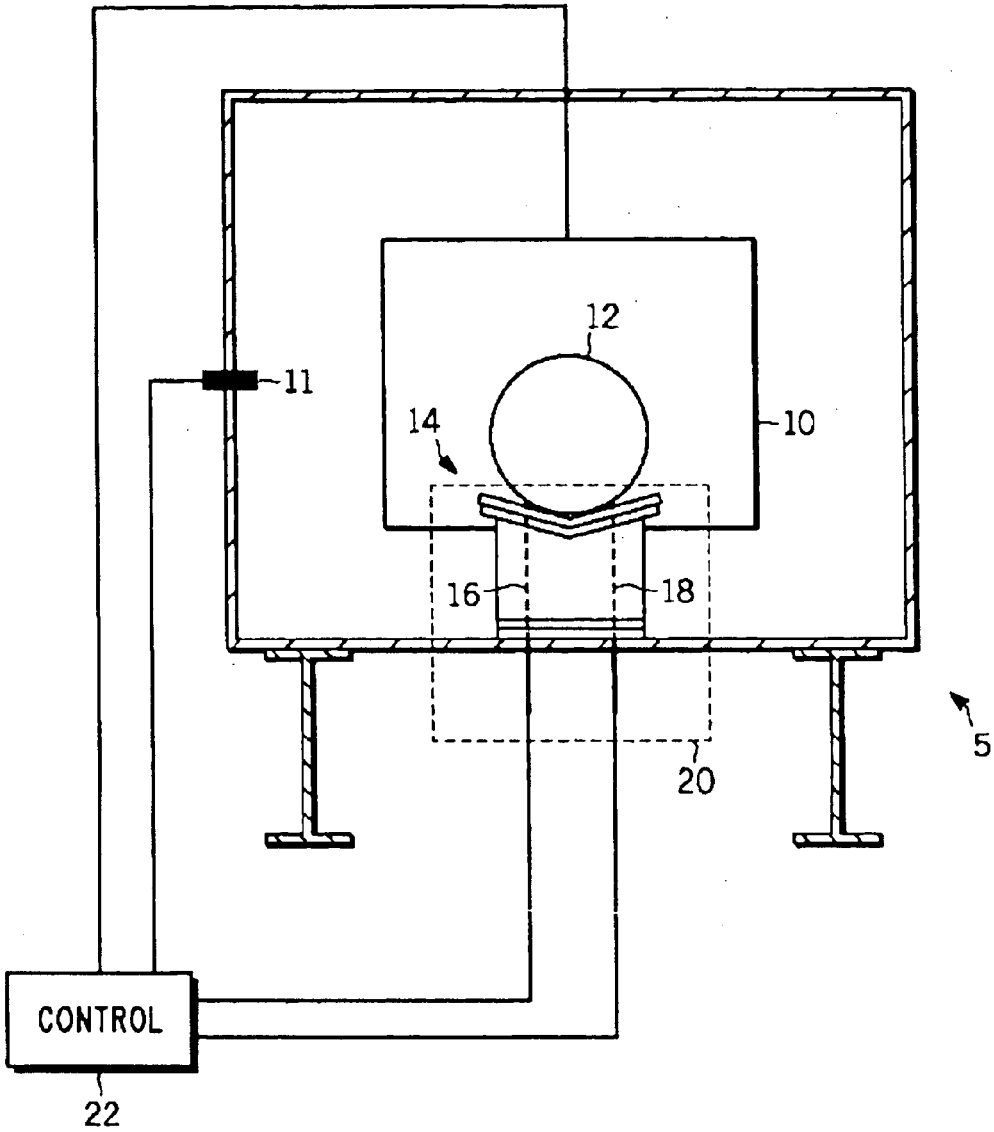
FIG. 1 shows a single cell die oven.

FIG. 1 shows a single cell die oven 5. Infrared heating elements 10 heat die 12. Die 12 rests on die cradle 14. Infrared heating elements 10 could consist of a pair of infrared heating elements. Die cradle 14 is spaced above the bottom of die oven 5. Alumel rod 16 and chromel rod 18 extend through platform 14 to contact die 12. Alumel rod 16 and chromel rod 18 form thermocouple 20. Thermocouple 20 is generally known as a Type K thermocouple. Thermocouple 20 is connected to control 22. Control 22 is also connected to infrared heating elements 10. Air temperature sensor 11 monitors the air temperature within die oven 5.

Control 22 reads the temperature from thermocouple 20 and air temperature sensor 11. It also modulates the temperature of infrared heating elements 10. Thus, in response to the temperature of die 12 and air temperature sensor 11, control 22 can either increase or decrease the heating level of infrared heating elements 10.

Figure 2:
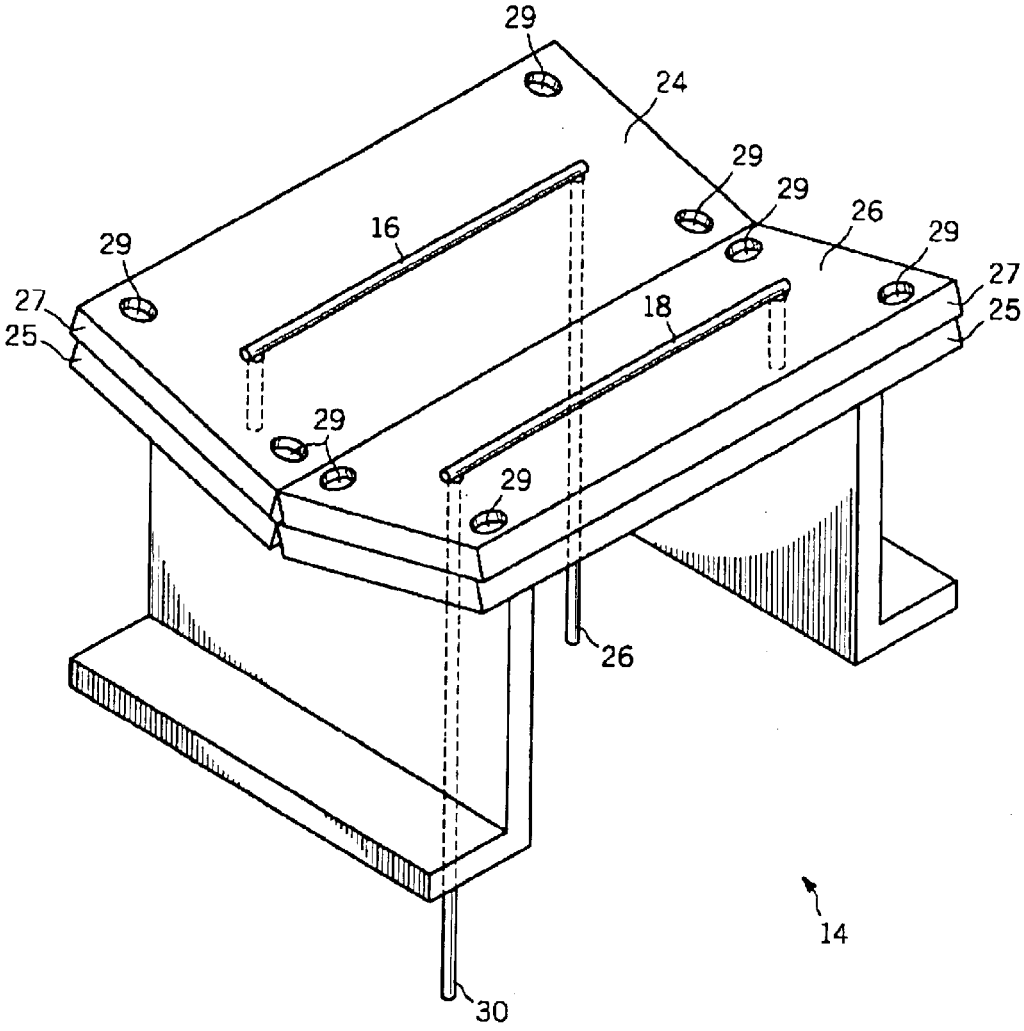
FIG. 2 is a perspective view of a die cradle.

FIG. 2 is a perspective view of die cradle 14. Alumel rod 16 extends through first mantle 24 and then laterally across the top of first mantle 24. Alumel rod lead 26 extends out of die oven 5 and to controller 22. Chromel rod 18 extends through second mantle 26 and laterally across the top of second mantle 26. Chromel rod lead 30 extends out of die oven 5 and to controller 22.

First mantle 24 and second mantle 26 are composed of lower sections 25 and upper sections 27. Lower sections 25 are made of stainless steel.

Because the rods 16, 18 extend across the top surface of mantles 24, 26, the rods must be electrically insulated from the stainless steel lower sections 25. Upper sections 27 are made of a material which can withstand the high temperatures of the die oven and also electrically insulate the rods from the stainless steel. Mica board is a suitable material for upper sections 27. Upper sections 27 are attached to the lower sections 25 by a plurality of screws 29.

Figure 3:
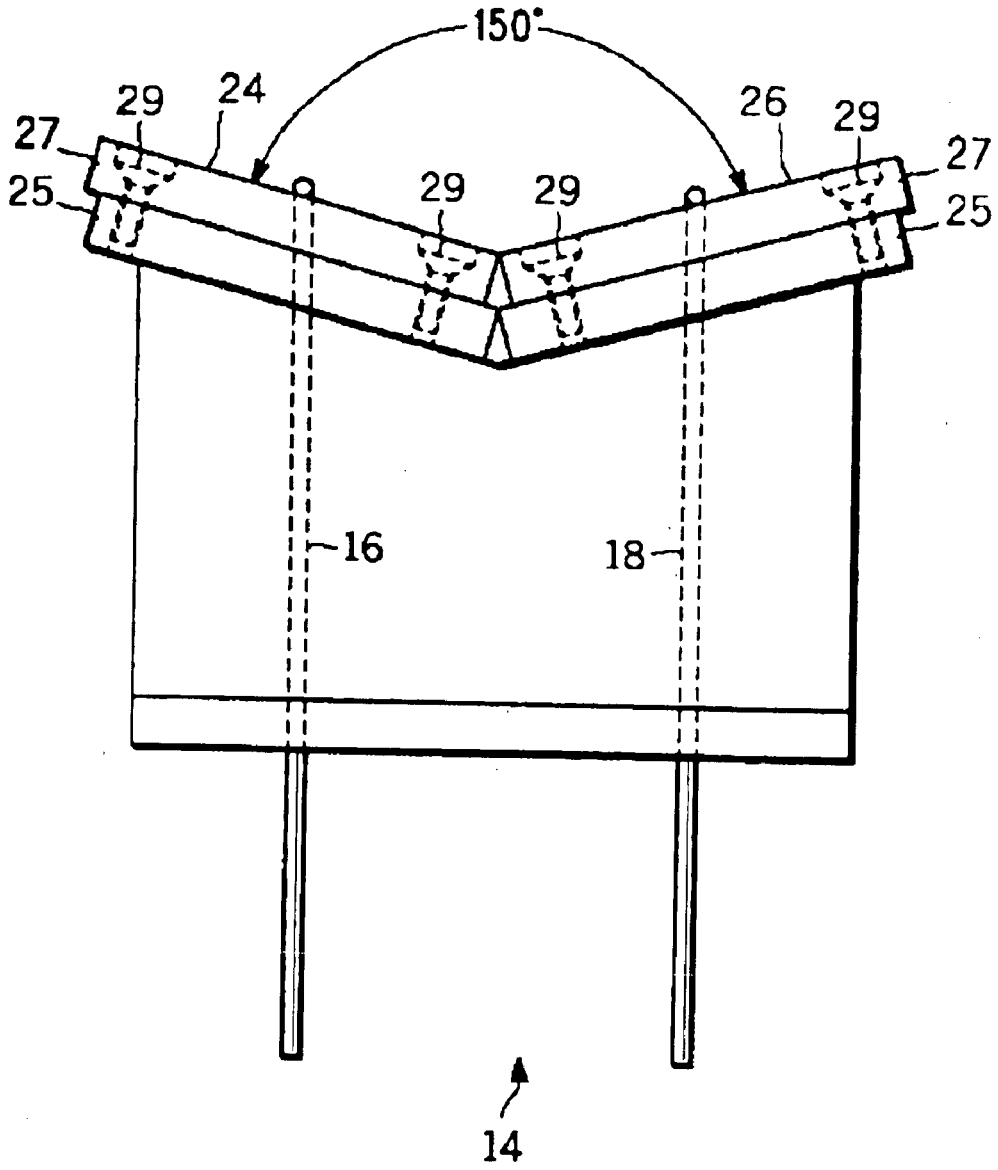
FIG. 3 is a side view of a die cradle.

FIG. 3 is an end view of die cradle 14. The angle between first mantle 24 and second mantle 26 is approximately 150 degrees. Alumel rod 16 and chromel rod 18 extend vertically to and through the floor of die oven.

The geometry of first mantle 24 and second mantle 26 as well as alumel rod 16 and chromel rod 18 insures that die 12, when placed upon die cradle 14, will be in direct contact with alumel rod 16 and chromel rod 18.

The arrangement as described herein will hold most dies in a size range of about 10" to 16" inch diameters. Obviously, if larger or smaller dies were used, the position of the rods and mantles may need to be changed.

Figure 4:
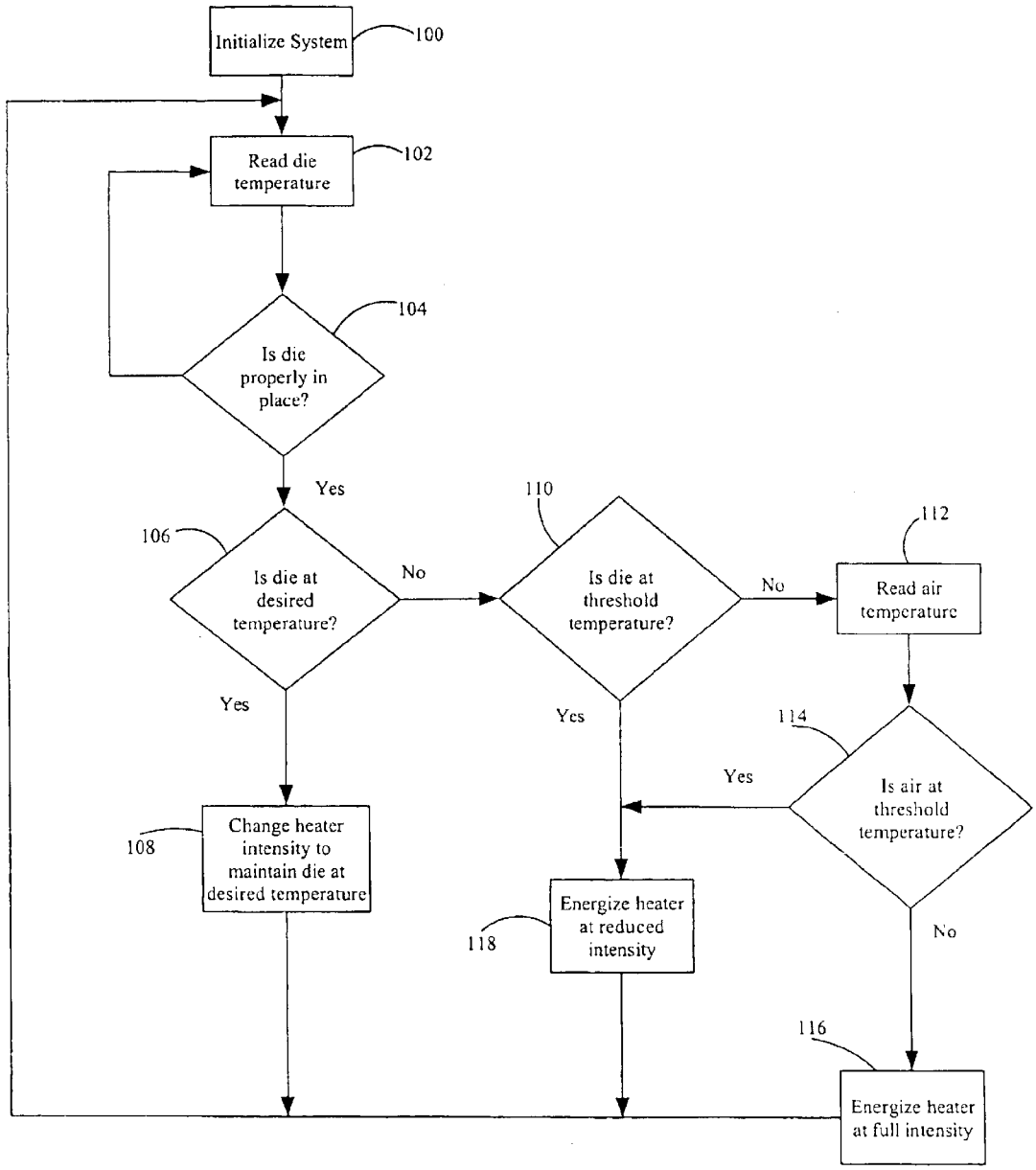
FIG. 4 is a flowchart for the operation of a die oven.

FIG. 4 shows a flow chart for the operation of the heater after a die is placed onto the die cradle and the lid is closed. The system is initialized. Step 100. The temperature of the die is then read. Step 102.

The system then determines if the die is properly positioned within the cradle. Step 104. If the die is not properly positioned so that it is in contact with the rods 16, 18, then the infrared heating elements will not be energized. Thus, the risk of over-heating an improperly positioned die is reduced.

If a temperature reading is obtained from thermocouple formed by rods 16, 18, then the temperature of the die is checked. Step 106. If the die is at the desired temperature, then infrared heating elements 10 is energized at an intensity level sufficient to maintain the die at that temperature. Step 108.

If the die is not at the desired temperature, then the temperature of the die is compared with a die threshold temperature. Step 110. If the die is not at the threshold temperature, then the air temperature within the oven is measured. Step 112. The air temperature is compared with an air threshold temperature. Step 114. If the air temperature is not equal to or greater than the air threshold temperature, then the heater is energized at a first intensity level. Step 116. The air threshold temperature is generally higher than the die threshold temperature. The difference between the air threshold temperature and the die threshold temperature would be based upon the size and shape of the die to be heated.

In one embodiment, the first intensity level corresponds to the maximum intensity level of the heater. The process then starts again with the reading of the die temperature. Step 102.

As noted previously, infrared heating elements 10 will continue to radiate heat for some time after it is turned off. Thus, to precisely control the temperature of the die, the intensity level of infrared heating elements 10 must be adjusted prior to the die reaching the desired temperature. Thus, if the die is at the threshold temperature or if the air temperature within the die oven is at the threshold temperature, the heating level of infrared heating elements 10 is energized at an intensity level appropriate for continuing the heating process without causing excessive overshoot of the desired temperature. The element intensity is constantly adjusted by control 22 so as to optimize heat up time and temperature control. Step 118. This second intensity level is generally less than the first intensity level. The precise settings for the intensity levels vary based upon the particular application. The intensity levels for the infrared heating elements may vary based upon factors such as the size and shape of the die and instantaneous temperature readings. Steps 102 and 112. Generally speaking, element intensity is reduced as temperature readings approach the desired temperatures.

The advantages of such a system are many. The temperature of the die can be precisely controlled. There is no guesswork. Dies of different sizes could be used within the die oven as long as the die is in contact with the probes when placed into the oven.

Also, the die oven allows dies of different temperatures can be placed into the die oven without fear of damaging the die. This allows for dies to be held at a temperature above room temperature but below the desired temperature. Thus, it would be possible to reduce the time to ready a die for use in a press by holding the die at a high temperature, and then raise the temperature of the die to the desired temperature in the die oven. If a die had to be removed from the press for some reason, the die would need only to be placed in the die oven to be reheated. It would not need to be allowed to cool to room temperature. Thus, the amount of time the press would be inoperable is reduced.

The above description is of the preferred embodiment. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

What is claimed is:

1. A die oven for heating a die comprising:

a heater, the heater having a heating intensity;

a die cradle for holding the die;

a temperature gauge in physical contact with the die when the die is placed in the die oven, the temperature gauge producing a die temperature signal; and a controller coupled to the temperature gauge and the heater, the controller controlling the heater in response to the die temperature signal.

2. The die oven of claim 1 where the temperature gauge is a thermocouple.

3. The die oven of claim 2 where the thermocouple is comprised of a first rod and a second rod.

4. The die oven of claim 3 further comprising an air temperature sensor for reading an air temperature within the die oven.

5. The die oven of claim 4 where the die cradle has a first mantle and a second mantle arranged so as to hold the die.

6. The die oven of claim 5 where the first rod is at least partially attached to the first mantle.

7. The die oven of claim 6 where the second rod is at least partially attached to the second mantle.

8. The die oven of claim 7 where the first rod extends laterally across the first mantle and the second rod extends laterally across the second mantle.

9. The die oven of claim 8 where the first mantle and the second mantle are juxtaposed and form an angle of about 150 degrees.

10. The die oven of claim 9 where the first mantle forms an angle of about 15 degrees with the horizontal and the second mantle form an angle of about 15 degrees with the horizontal.

11. The die oven of claim 10 where the first rod is composed of alumel and the second rod is composed of chromel.

12. A method for operating a die oven for heating a die, the die oven having a controller, a thermocouple in direct contact with the die, a heater, the heater having an intensity, and a controller, the controller coupled to thermocouple and the infrared heating elements, comprising:

reading the thermocouple to obtain a die temperature; and adjusting the intensity in response to the die temperature.

13. The method of claim 12 further comprising:

determining whether the die is properly positioned within the die oven; and energizing the heater only if the die is properly positioned within the die oven.

14. The method of claim 13 further comprising:

comparing the die temperature with a threshold temperature; and if the die temperature is greater than the threshold temperature, reducing the intensity.

15. A method for operating a die oven for heating a die, the single cell die oven having a controller, a thermocouple in direct contact with the die, an infrared heating elements having an intensity, and a controller, the controller coupled to thermocouple and the infrared heating elements, comprising:

energizing the infrared heating elements at a first intensity level;

continuously reading a die temperature from the thermocouple;

when the die temperature exceeds a threshold temperature, energizing the infrared heating elements to a second intensity level; and when the die temperature reaches a desired temperature, energizing the infrared heating elements to a third intensity level.

16. The method of claim 15 where, after the die temperature reaches a desired temperature, the intensity is continually adjusted to maintain the die temperature near the desired temperature.

17. The method of claim 16 where the first intensity level is greater than the second intensity level.

18. The method of claim 17 where the first intensity level is greater than the third intensity level.

19. The method of claim 18 further including the step of reading an air temperature within the die oven.

20. The method of claim 19 further including the step of energizing the infrared heating element at a second intensity level if the air temperature is at the threshold temperature.

21. A die cradle for an infrared die oven comprising:

a first mantle;

a second mantle;

a first rod extending laterally across the first mantle;

a second rod extending laterally across the second mantle; and where the first mantle and the second mantle are arranged to form a "V".

22. The die cradle of claim 21 where the first rod extends at least partially through the first mantle.

23. The die cradle of claim 22 where the second rod extends at least partially through the second mantle.

24. The die cradle of claim 23 where the first mantle and the second mantle form a V-shape, the V-shape has an angle, and the angle is about 150 degrees.

25. The die cradle of claim 24 where the first mantle and the second mantle are arranged to hold a generally cylindrical die.

26. The die cradle of claim 25 where the first rod and the second rod are arranged so that, when a cylindrical die is placed within the first mantle and the second mantle, the first rod and the second rod are in direct contact with the cylindrical die.

27. The die cradle of claim 26 where the first rod and the second rod form a thermocouple.

28. The die cradle of claim 27 where the first rod is composed of alumel and the second rod is composed of chromel.

* * * * *